United States Patent [19]

Revene

[11] Patent Number: 4,532,657

[45] Date of Patent: Aug. 6, 1985

[54] ONE-PIECE TIGHTS-TYPE GARMENT

[75] Inventor: Nadine Revene, New York, N.Y.

[73] Assignee: Aris Isotoner Gloves, Inc., New York, N.Y.

[21] Appl. No.: 612,552

[22] Filed: May 21, 1984

[51] Int. Cl.[3] ..... A41B 9/04

[52] U.S. Cl. ..... 2/409

[58] Field of Search ..... 2/409, 406, 407, 239, 2/79, 80

[56] References Cited

U.S. PATENT DOCUMENTS

| | | | |
|---|---|---|---|
| 504,402 | 9/1893 | Pike | 2/409 X |
| 1,211,766 | 1/1917 | Schremp | 2/409 |
| 2,203,401 | 6/1940 | Barnard | 2/409 X |
| 2,466,545 | 4/1949 | Hessel | 2/406 |
| 3,435,461 | 4/1969 | Artzt | 2/80 |
| 3,613,119 | 10/1971 | Sarmiento | 2/407 X |
| 4,031,565 | 6/1977 | Coates | 2/409 X |
| 4,462,118 | 7/1984 | Bauditch | 2/243 B X |

*Primary Examiner*—H. Hampton Hunter

*Attorney, Agent, or Firm*—Charles Y. Lackey; William S. Burden

[57] ABSTRACT

This invention is directed to a type of garment commonly referred to as tights, which is constructed in a novel manner utilizing one piece of fabric. A desirable body-conforming shape is imparted to the garment by utilizing a fabric blank cut from a single layer of knitted material in which the severed edges are seamed together to define one continuous seam extending from one toe portion, along the back of one leg portion, to the seat portion of the garment, and then downwardly along the back of the other leg portion and to the other toe portion. A second seam extends from the continuous seam, through the garment crotch portion, and upwardly at the front of the garment, terminating at the waist.

10 Claims, 4 Drawing Figures

ONE-PIECE TIGHTS-TYPE GARMENT

This invention relates to improvements in a type of garment commonly referred to as tights, and more particularly to a garment constructed from a single piece of fabric having a desired configuration.

The tights garment is constructed from a single thickness of knitted fabric of unique shape having the desired elastic characteristics and qualities, and may be of a stretch-type fabric which provides a massaging action to the legs.

In the present invention the body, waist, crotch, leg, foot and toe portions are all formed from a single fabric piece having only two seams. However, the toe portions may also be closed by seaming or by other suitable means. One inverted, generally U-shaped seam extends from a toe portion, beneath the foot, along the back of the leg and to the seat of the garment and returns along the back of the outer leg and to the other toe portion. The second seam extends from the waist, at the front of the garment, through the crotch portion and terminates at the first seam.

One of the primary objects of the invention is the provision of a new and improved tights-type garment composed of a single fabric blank, and which is form-fitting and comfortable to the wearer.

Another feature of the invention is that only two seams are present to form the garment.

Another object of the invention is the provision of a tights garment which is simple in construction and readily lends itself to economical and efficient production.

Other advantage and objects of the invention will become apparent when considered in view of the following detailed description.

DETAILED DESCRIPTION OF THE INVENTION

Figure 1:
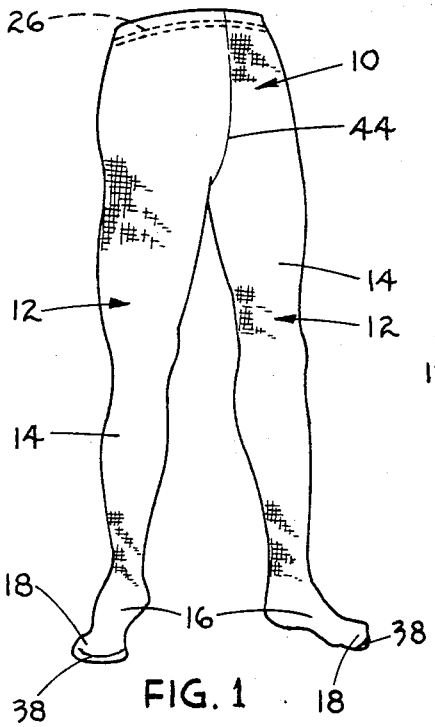
FIG. 1 is a front perspective view of a garment embodying my invention.

Referring to the drawing, the tights garment disclosed includes integral half sections A and B which include an upper body or trunk portion 10 and depending, elongated portions 12, 12, each including leg 14, foot 16 and toe 18 portions.

Figure 4:
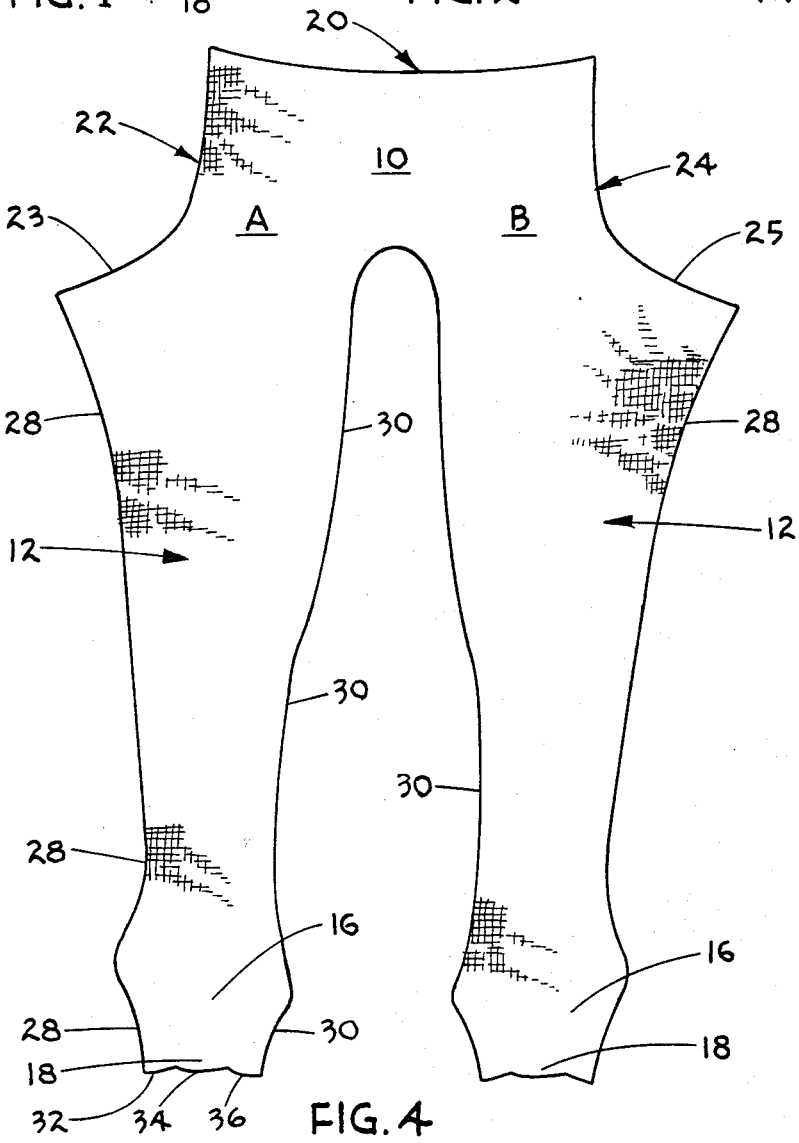
FIG. 4 is a plan view of a single fabric blank from which the garment is made.

The garment is formed from a single piece of fabric cut to a desired configuration, as best illustrated by FIG. 4, wherein the trunk portion 10 includes a relatively straight upper edge 20 and opposite, outwardly curved edges 22 and 24, portions 23 and 25 of which are joined to define the crotch of the garment. The upper edge 20 defines the waist section, and may have an elastic band 26 embodied therein to support the garment upon the body of a wearer.

The depending portions 12, 12 are integral with trunk portion 10, and each portion 12, 12 includes outer opposite edges 28, 30 having the desired curvature or configuration so that when brought together and suitably united, the leg sections, with a seam at the rear, will have the appearance of full-fashioned hose. The edges 28, 30 also continue through the foot section 16.

The toe portion 18 ends in an edge defined by three distinct curved segments 32, 34, 36. The edge segments 32 and 34 are folded over the segment 36 and the toe may be closed by a seam 38, as shown by FIG. 1, or the toe portion may be closed by other suitable means.

Figure 2:
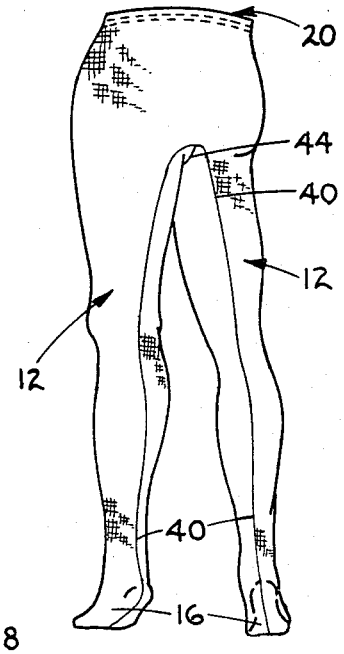
FIG. 2 is a rear perspective view of tights formed according to the present invention.
Figure 3:
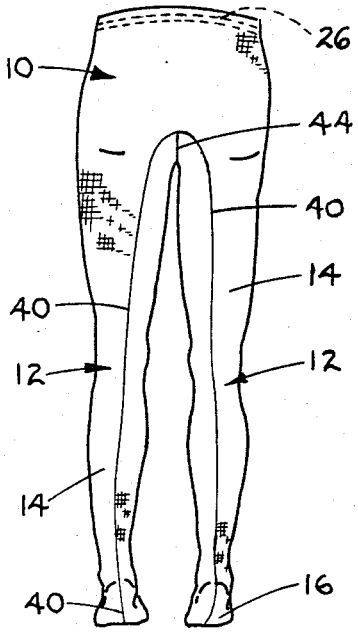
FIG. 3 is a rear view of the garment.

In constructing the garment, the edges 28, 30, of each portion 12 are folded so as to be brought together and then are secured by a seam 40. The seam 40 extends from beneath the foot section 16 of one elongated portion 12 to a location beneath the foot section 16 of the other elongated portion 12. Preferably the seam 40 is continuous. As shown by FIGS. 2 and 3, seam 40 is generally in the form of an inverted U, extending to the seat of the garment.

The edges 22 and 24 are brought together and secured by a seam 44 to close the trunk portion 10 and define the crotch of the garment. The seam 44 extends from the upper edge 20 of the waist, at the front of the garment, through the crotch, and terminates at the uppermost section of the seam 40.

Thus it will be seen that the completed depending leg and foot portions are secured in leg- and foot-encompassing relation by a single seam 40, and the trunk portion is formed by a single seam 44. The construction of the garment-is greatly simplified by the configuration of the single blank, resulting in a comfortable form-fitting garment.

If so desired, a crotch piece, not shown, may be secured in the garment by seam 44, or by other suitable means.

What is claimed is:

1. A tights-type garment comprising a single fabric blank defining a trunk portion and a pair of elongated depending portions, said trunk portion including a relatively straight edge defining a waist section for encircling the waist of a wearer, each of said pair of elongated depending portions including a leg section and a foot section having a toe portion, said leg and foot sections of each of said pair of elongated depending portions having edges joined together by a first seam, said first seam extending from the toe portion of one foot section, along the leg section to the juncture of said trunk portion with said elongated depending portions, and to the toe portion of the other foot section, said trunk portion including edges secured together by a second seam extending from said waist section to said first seam.

2. A tights-type garment as recited in claim 1, wherein said first seam is a generally inverted U-shape in a configuration extending from one foot section to the rear seat portion of the garment, and then to the other foot section.

3. A tights-type qarment as recited in claim 1, wherein said second seam extends from the waist section at the front of the garment downwardly to join said first seam.

4. A tights-type garment as recited in claim 3, wherein said first and second seams converge at the seat portion of said garment, said second seam joining portions of trunk portion to define the crotch of said garment.

5. A tights-type garment as recited in claim 1, said trunk portion and said pair of elongated depending portions being integral, formed from a single layer of fabric.

6. A tights-type garment as recited in claim 5, said fabric being of knitted, elastic construction.

7. A tights-type garment comprised of a single piece of fabric defining left and right half sections, said left and right half sections having upper portions integral with each other, said upper portions defining a relatively straight upper edge defining a waist opening, and opposed downwardly and outwardly curved edges, said downwardly and outwardly curved edges being joined by a first seam to define a garment trunk portion, each of said left and right half sections including an elongated, depending leg and foot portion having opposite edges, said opposite edges being brought together in edge-to-edge relation, and a continuous seam joining together the edges of depending leg and foot portions to define a pair of leg and foot covering portions.

8. A tights-type garment as recited in claim 7, wherein said continuous seam is at the back of the leg and foot covering portions, and wherein said first seam extends from the front of the garment trunk portion and joins said continuous seam at the seat portion of the garment.

9. A tights-type garment as recited in claim 8, said single piece of fabric being of elastic fabric.

10. A tights-type garment including a trunk portion defining a waist opening and bifurcated leg and foot portions, said garment being constructed from a one-piece blank of knitted, elastic fabric, a first continuous seam extending from the rear of one leg and foot portion upwardly to the seat of the garment and then downwardly at the rear of the other leg and foot portion, said continuous seam being generally in the configuration of an inverted U, and a second seam extending downwardly from the front, of the trunk section, through the garment crotch, and to said continuous seam.

* * * * *